11/26/85 OR 4,554,745 SR

United States Patent [19]

Repa

[11] Patent Number: 4,554,745

[45] Date of Patent: Nov. 26, 1985

[54] DEVICE FOR ALIGNING AN ADJUSTABLE SIGHT ELEMENT IN A SIGHT SYSTEM FOR RIFLES

[75] Inventor: Otto Repa, Oberndorf, Fed. Rep. of Germany

[73] Assignee: Carl Walther GmbH, Ulm, Fed. Rep. of Germany

[21] Appl. No.: 587,056

[22] Filed: Mar. 7, 1984

[30] Foreign Application Priority Data

Mar. 10, 1983 [DE] Fed. Rep. of Germany ..... 3308552
Jul. 26, 1983 [DE] Fed. Rep. of Germany ..... 3326853

[51] Int. Cl.[4] ..... F41G 1/02
[52] U.S. Cl. ..... 33/257; 33/248
[58] Field of Search ..... 33/257, 233, 234, 235, 33/247, 248, 252, 258, 260

[56] References Cited

U.S. PATENT DOCUMENTS

| | | | |
|---|---|---|---|
| 2,161,051 | 6/1939 | Humeston | 33/248 |
| 2,208,913 | 7/1940 | Unertl | 33/248 |
| 2,424,011 | 7/1947 | De Gramont | 33/248 |
| 4,037,325 | 7/1977 | Weber et al. | 33/125 C |
| 4,373,269 | 2/1983 | Doliber et al. | 33/248 |

*Primary Examiner*—Willis Little

[57] ABSTRACT

An adjustable sight element in a sight system for a rifle and the like may comprise an aperture disc for a peep sight or an adjustable sight structure for a telescope sight. The adjustable sight element is adjustably mounted for movement about vertical axis and a horizontal axis in a stationary housing attached to the rifle. The magnitude or degree of the vertical and horizontal displacement of the adjustable sight element is indicated by a capacitance or optronic measuring device and is displayed digitally in electronic digital fields. The electronic component is located in a casing which is removably attached to the housing.

16 Claims, 6 Drawing Figures

DEVICE FOR ALIGNING AN ADJUSTABLE SIGHT ELEMENT IN A SIGHT SYSTEM FOR RIFLES

The present invention relates to sight systems for rifles, more particularly, to a device for aligning the adjustable sight element of a peep sight or telescope sight on a rifle.

One form of a sight system, particularly for a rifle, is an open or peep sight having a stationary housing attached to the rifle's receiver and within the housing there is mounted a vertically and horizontally adjustable aperture disc. In DE-GM 16 29 465, there is disclosed a vertically and horizontally adjustable peep sight having an adjustable sight disc with an aperture therein mounted in the sight housing. The sight disc can be adjusted for windage and elevation by turning adjustment knobs which actuate screw adjustment devices which control the movement of the aperture disc or of a structure attached to the aperture disc. The adjusting screws are provided with quick-stop devices which permit graduated adjustment of the aperture disc. The user of the fire arm can correct sight alignment by adjusting the aperture disc according to the measured deviation of the shot group from the center or bull's eye of the target.

This prior art sighting device, as described above, has the disadvantage that during the process of aligning the adjustable aperture disc there is no indication of the absolute value of the horizontal and/or vertical displacement of the aperture disc. The only indication of these displacements is provided by the number of graduations which can be read from the reference lines when turning the adjusted knobs. Since it is frequently necessary to make several rotations of the adjustment knob during an aligning process, the marksman or user of the firearm must count these rotations when changing settings and note precisely the number of graduations. In addition, there is inevitably end play in the screw threads of the adjustment screws and in the guides of the movable aperture disc. This end play is particularly evident when beginning the turning of the adjustment screws and upon changing the direction of rotation of the screws. There is thus no assurance that the aperture disc is always precisely displaced to the same degree vertically or horizontally.

The same problem is also existent in devices for the aligning of various forms of telescope sights mounted on rifles.

It is therefore the principal object of the present invention to provide a novel and improved device for aligning an adjustable sight element in a sight system for sporting rifles and the like.

It is another object of the present invention to provide such an alignment device which simplifies the alignment of the sight.

It is a further object of the present invention to provide an aligning device for both open sights and telescope sights mounted on rifles which indicates visually the degree of horizontal and vertical movement of the adjustable sight element.

It is an additional object of the present invention to provide an aligning device for a firearm sight system, particularly for rifles wherein the magnitude of the horizontal and vertical movement of an adjustable sight element is indicated at all times and may be displayed visually.

The objects of the present invention are achieved and the disadvantages of the prior art as described herein are overcome by the present invention wherein movement of the adjustable sight element is measured electronically such that the actual magnitude of displacement of the sight element can be precisely determined and is not affected by end play or the like. A digital display is provided which affords the marksman a precise and rapid reading of the alignment data. Since the electronic component is both removable and interchangeable among rifles, the user has the option of aligning the sight either mechanically or electronically and can always reattach the electronic component when he so desires.

According to one aspect of the present invention, there is provided a device for aligning an adjustable sight element in an open sight system or a telescope sight for rifles and the like. The device includes the housing which is adapted to be attached to the rifle and there is a vertically and horizontally adjustable sight element mounted within the housing. A digital read-out structure is provided to indicate visually the magnitudes of the horizontal movement and vertical movement of the adjustable sight element from a predetermined zero setting. The adjustable sight element may comprise the sight disc or aperture disc of an open or peep sight or the reticle or erector lens of a telescope sight mounted on the rifle. The adjustable sight element may also include the telescope sight which is adjustably supported upon a mount fixed on the rifle.

Other objects and advantages of the invention will be apparent upon reference to the accompanying description when taken in conjunction with the following drawings, which are exemplary, wherein.

Preceding next to the drawings, wherein like reference symbols indicate the same parts throughout the various views, a specific embodiment and modification of the present invention will be described in detail.

Figure 1:
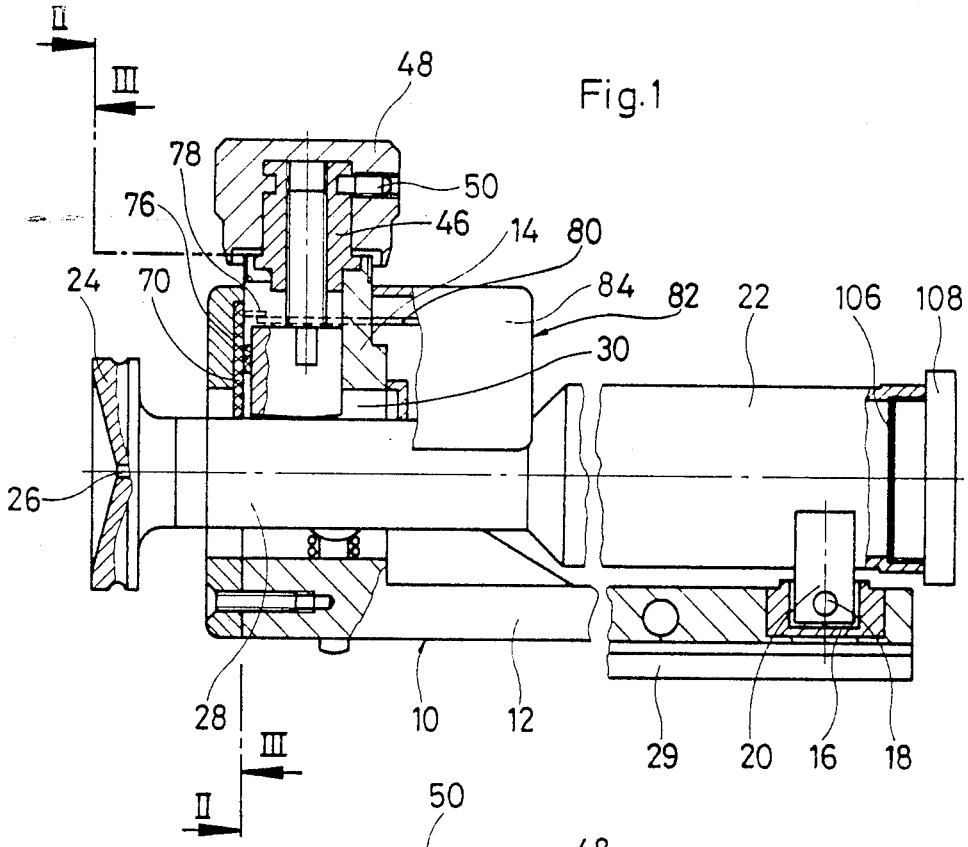
FIG. 1 is a side elevational view of the aligning device according to the present invention with a portion thereof shown in section.

In FIG. 1 there is shown an open or peep sight having a housing 10 which is detachably mounted upon a rifle in a manner as known in the art. The housing 10 is L-shaped and comprises a horizontal leg 12 and a vertical leg 14. At the forward end of the horizontal leg 12 which is at the right-hand end of the frame as viewed in FIG. 1, there is a universal joint 16 having a horizontal axis 18 running transversely with respect to the line of sight of the rifle and a vertical axis 20. A sight tube 24 has its front end fastened to the universal joint on the vertical axis 20. At the other or rear end of the sight tube 22, there is an aperture disc 24 having an aperture or peep hole 26. The underside of the horizontal leg 12 of the frame 10 is provided with a dovetail guide 29 by means of which the housing is attached to the rifle by sliding insertion of the dovetail guide 29 into a correspondingly shaped groove.

Figure 2:
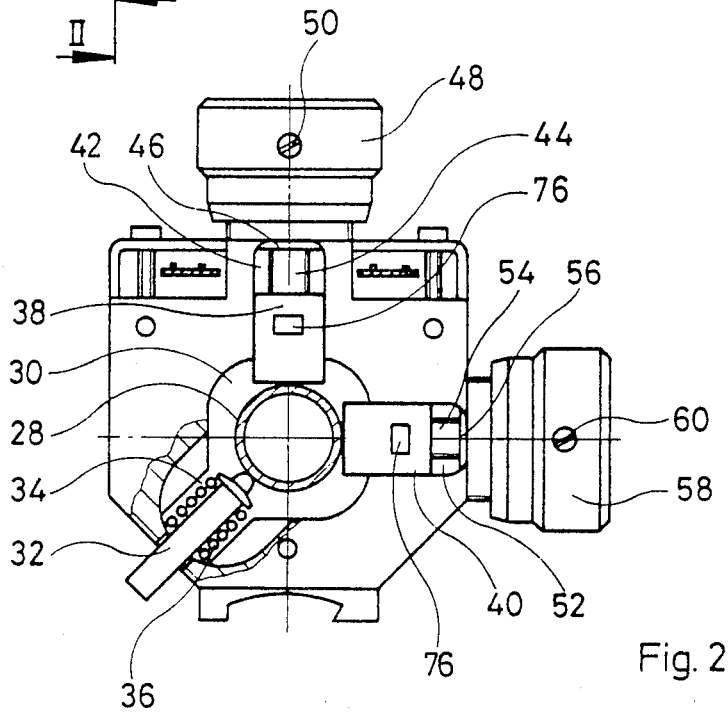
FIG. 2 is a sectional view taken along the line II—II of FIG. 1.

Sight tube 22 has a rearward portion 28 which is of a smaller diameter and extends through an opening 30 in the vertical leg 14 of the housing 10. As may be seen in FIG. 2, a pin 32 extends into the opening 30 of the vertical leg 14 and the pin 32 is seated in a radial bore 34 and spring-loaded by a spring 36. The pin 32 presses horizontally and vertically on the sight tube 28 at an angle of 45°. Under the force exerted by this spring-loaded pin 32, the exterior surface of the sight tube segment 28 is urged against two thrust pads 38 and 40. The thrust pad 38 moves upwardly and downwardly on a vertical guide 42 within frame leg 14. Connected to the thrust pad 38 is a threaded spindle shaft 44 which extends upwardly through a spindle nut 46. The spindle nut 46 is rotatably mounted in the frame leg 14 and seated without any displacement or play. At the top end of the spindle nut 46 there is mounted an adjustment knob 48 which could be in the shape of a knurled nut. The adjustment knob 48 is firmly connected to the spindle nut 46 by a removable set screw 50.

The thrust pad 40 operates from the side or horizontally upon the sight tube segment 28 and moves in a horizontal guide 52 in the frame leg 14. The guide 52 is positioned at an angle of 90° with respect to the guide of the thrust pad 38. The horizontal thrust pad 40 is constructed similarly to the vertical thrust pad 38 and has a threaded spindle shaft 54, a spindle nut 56, an adjustment knob 58 retained in position by a set screw 60. Rotating of the adjustment knob 48 thus displaces the sight tube in a vertical direction and rotating of the adjustment knob 58 brings about a displacement of the sight tube 22 in the horizontal direction against the force of the spring-loaded pin 32.

The electronic measuring device incorporated in the present invention operates according to the known and proven principle of using a differential capacitor for the measurement of lengths. Such a differential capacitor consists of two electrodes positioned next to each other in a plane and a third electrode is arranged parallel to the two electrodes at a predetermined distance. The third common electrode is movable parallel to the fixed first and second electrodes. Because of the separation of the two elements of the fixed capacitor electrodes, partial capacitances are generated which, upon displacement of the third common electrode, are constantly changing. The sum of total capacitance resulting from the partial capacitances is constant. If the relationship of the partial capacitances to the total capacitance is measured, the obtained result is directly an indication of the magnitude of displacement to the right or to the left. By means of a suitable electronic circuit, the differential capacitance is converted into a constant voltage which functions as an output signal whose magnitude is similarly a linear or direct function of the displacement.

Figure 3:
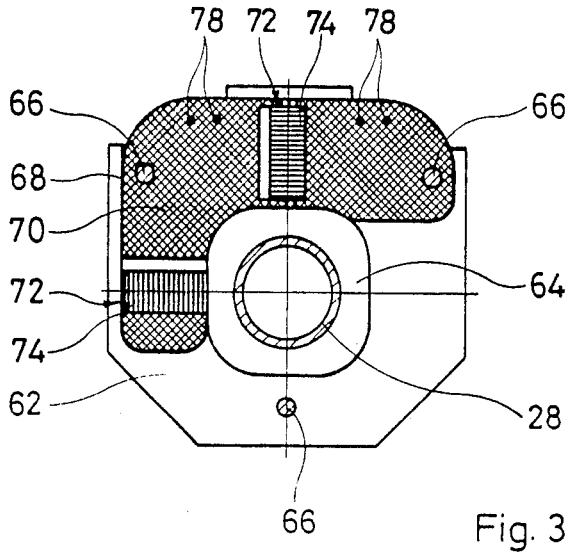
FIG. 3 is a sectional view taken along the line III—III of FIG. 1.

The fixed portion of the differential capacitor is illustrated in FIG. 3 wherein a surface of the frame leg 14 facing toward the front of the sight is covered by a plate 62 having a central opening 64 which coincides and registers with the opening 30 in the frame leg 14. The plate 62 is secured by screws 66 to the frame leg 14. The plate 62 is provided with a recess 68 in which an electronic printed circuit board 70 is positioned. The fixed portion of the differential capacitor is mounted upon the circuit board 70 and is constructed as a reading head 72 which comprises a large number of thin conductive strips 74 which extend horizontally and are disposed vertically one below another. Four successive strips 74 make up the fixed first electrode and the next four successive strips 74 make up the fixed second electrode of the differential capacitor.

The movable member of the differential capacitor is in the form of a common electrode 76 which is mounted on the outer surface of the thrust pad 38. The electrode 76 is positioned at a distance of about 0.4 mm. from the reading head 72 in such a manner that eight strips 74 of the reading head 72 together with the movable electrode 76 comprise the differential capacitor. If the electrode 76 moves as a result of displacement of the thrust pad 38 with respect to the reading head 72, then at the end of each measurement interval corresponding to a strip 74, the width of one strip will be electronically transmitted so as to follow the progressive or graduated movement from step to step. The measurement of the displacement is thus produced from the sum of these steps and the voltage changes measured in the intervals between them.

In a similar manner, the horizontal displacements of the thrust pad 40 are also measured. The displaceable electrode 76 operates in conjunction with reading head 72 and the electrode 76 is mounted on the outer surface of the horizontal thrust pad 40 as may be seen in FIG. 2. The circuit board 70 is connected to an electronic component 82 through contact 78 on the circuit board 70 in engagement with contacts 80 extending from the electronic component 82. The electronic component 82 is enclosed within a removable casing 84 attached to the housing 10.

The movable electrodes 76 for both the vertical and horizontal measurements can be attached, as a modification, directly to the movable sight tube segment 28 and can operate in conjunction with the stationary reading head 72 attached to the housing 10. As a further modification, several electrodes 76 could also be arranged one above the other along the axis of displacement. These electrodes 76 together with the eight parallel strips 74 would define a differential capacitor.

The present invention should not be limited to capacitance measuring devices since other known systems, for example, optronic, can similarly be used for measurement of the vertical and horizontal displacements of the aperture disc of the sight.

Figure 4:
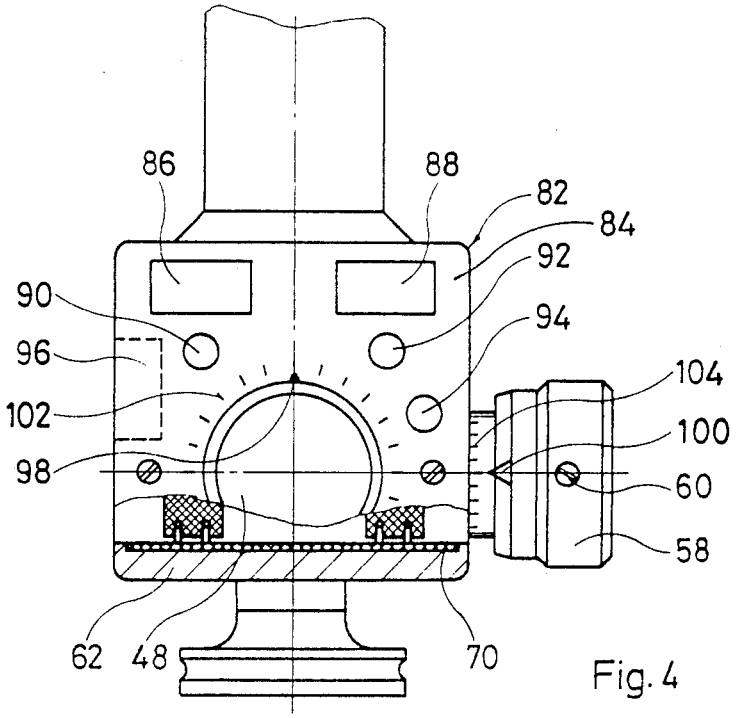
FIG. 4 is a top plan view of the aperture disc sight shown in FIG. 1.

As may be seen in FIG. 4, the electronic component 82 has display screens 86 and 88 which provide for an electronic digital read-out. Such read-out screens are available commercially and in the small sizes necessary to be accommodated in the housing of the sight. Rotation of the adjustment knob 48 causes movement of the thrust pad 38 together with electrode 76 which moves relative to the fixed reading head 72 and the resultant voltage curve is measured. The constant voltage serving as an output signal is electronically measured and the degree of vertical displacement of aperture disc 24 is indicated digitally in display screen 86 by a known device mounted within the electronic component 82.

In a similar manner, rotation of the adjustment knob 58 provides for horizontal displacement of the aperture disc 24 and this horizontal displacement is similarly measured and the degree or magnitude of displacement is indicated visually in the digital read-out screen 88. The display screens 86 and 88 are individually and separately luminated by pressing push-buttons 90 and 92 respectively. Instead of two separate display screens 86 and 88, a single display screen could be provided and through appropriate electronic coupling the desired horizontal or vertical displacement would be indicated in the single display screen by pressing the suitable one of the push-buttons 90 or 92.

The electronic component 82 is provided with an additional push-button 94 for resetting to zero. A zero setting of the respective vertical or horizontal displacement can take place only when push-button 94 together with either push-button 90 or 92 are pushed simultaneously. From this zero setting as a base, the degree or magnitude of horizontal and vertical displacement of the aperture disc 24 can be measured within a tolerance of + or −0.01 mm. The vertical and horizontal displacement is preferably indicated by a H(high)and L(low), R(right) and L(left). If desired, it is also possible to use these symbols + and − instead of the letters as described.

In order to insure that the device is always ready to provide a digital read-out, it is possible to use a well-known electronic memory circuit. The memory circuit enables the last aperture setting to be stored in the memory. By pressing push-button 90 or 92, the respective last aperture setting will be displayed in the appropriate display screen 86 or 88.

A suitable electronic switch as known in the art can also be employed to cut off power to the electronic component automatically after a certain predetermined period of time has elapsed. When the device is reactivated, the zero indication will always appear in the display screens. The long-life battery 96 is provided in the housing of the electronic component to function as a power source for the electronic measuring device.

The adjustment knobs 48 and 58 may be provided with indicators or pointers 98 and 100, respectively, which operate in conjunction with graduated circumferential scales 102 and 104 respectively mounted on the frame leg 14 of the housing 10. The use of these indicia and graduated scales enables the disclosed aperture alignment device to be operated in a conventional mechanical fashion in the event of a failure or other malfunctioning of the electronic assembly. After the rifle has been sighted in, adjustment knobs 48 and 58 can be adjusted to the respective zero settings on the scales 102 or 104 by loosening the screws 50 or 60 which are then retightened after the zero setting has been completed.

The front end of the sight tube 22 may be provided with a filter 106 which is retained in place by a ring nut 108. If no filter is used, the sight tube 22 will function as a light screen against intrusive light and thus enhances optical conditions during the aiming process.

The present invention can also be used for telescope sights including both the adjustable sight wherein the telescope sight is rigidly mounted on the rifle and sight adjusting means are provided within the telescope sight and the fixed sight when the telescope sight is fixedly mounted on a mount which in turn is adjustable with respect to the rifle. Either the telescope sight itself or sight adjusting means within the telescope sight must be moved to provide for movement of the line of sight of the telescope sight with respect to the bore of the rifle. The present invention thus provides for aligning an adjustable sight element which may comprise the reticle of a telescope sight, the telescope sight itself when it is adjustably supported on a mount fixed on the rifle or a structure within the telescope sight when the telescope sight is fixedly mounted on the rifle. When the telescope sight is provided with a fixed sight barrel, the reticle is generally located near the objective. The tubular housing of the sight barrel then encloses an erector lens system which is between the occular and objective lens and which is movable so that the target image will move with respect to the reticle. Thus, the device of the present invention can be used with the adjustable sight element of the telescope sight.

In that construction wherein the entire telescope sight barrel is movable, the telescope sight can be mounted similarly to that of the sight barrel 22 shown in FIG. 1 such that the thrust members 38 and 40 contact directly the telescope sight.

Figure 5:
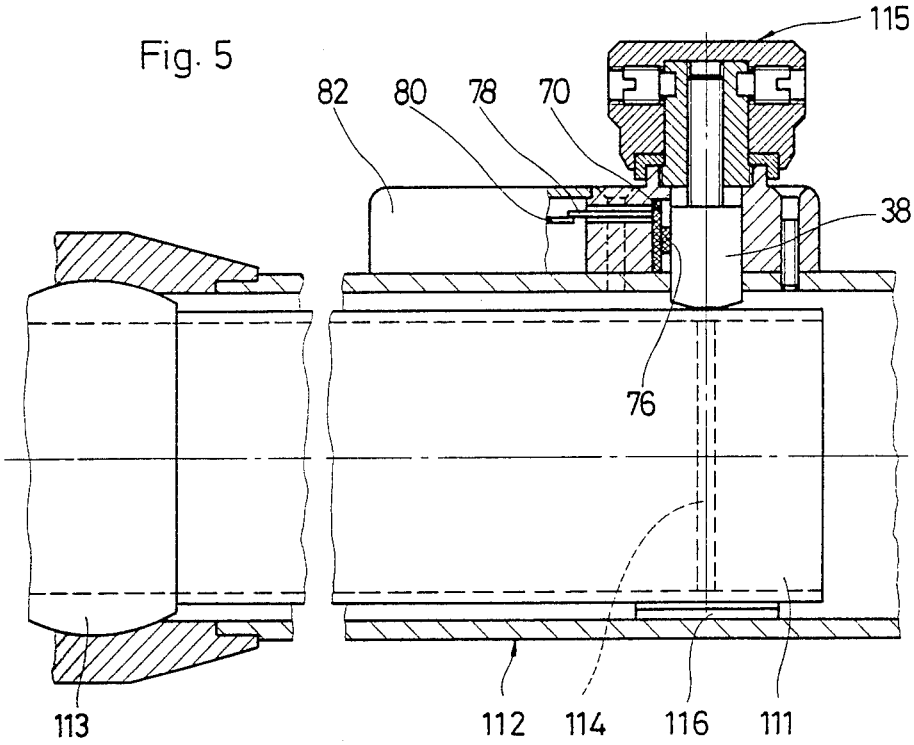
FIG. 5 is a longitudinal sectional view of a telescope sight incorporating the present invention.
Figure 6:
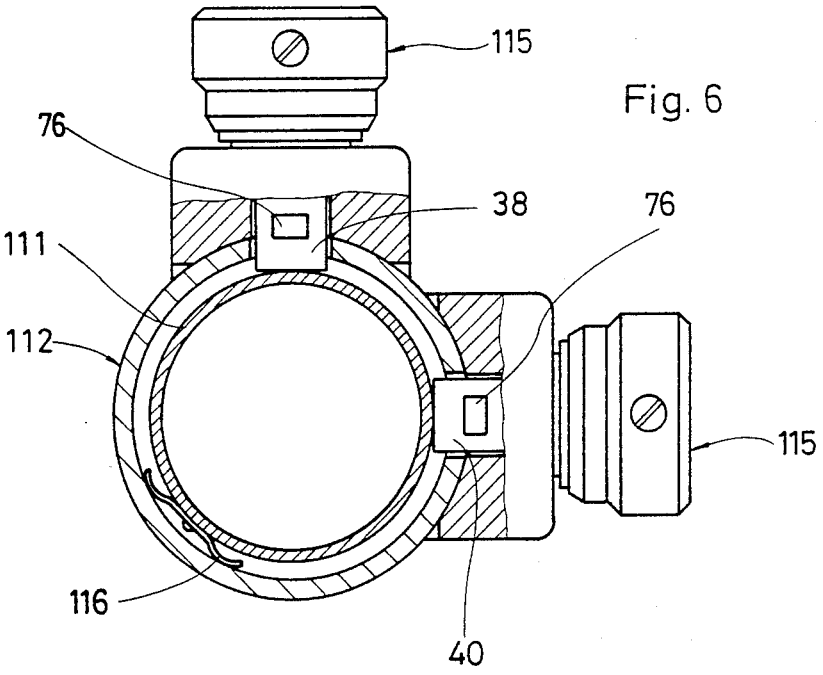
FIG. 6 is a transverse sectional view of the telescope sight of FIG. 5 and taken along the line 6—6 thereof.

As may be seen in FIGS. 5 and 6, the telescope sight illustrated therein comprises an inner tubular member 111 one end of which is pivotably mounted by means of a universal joint construction 113 located within the outer tubular member 112. The other or free end of the tubular member 111 is provided with a reticle cross hairs 114. In substantially the same plane as the reticle 114 there are positioned the thrust pads 38 and 40 as described above. A leaf spring 116 is also provided within the outer tubular member 112 to bear against the outer surface of inner tubular member 111 and the spring 116 is positioned at substantially a 45° angle as described above with respect to the spring loaded pin 32. The structure and operation of the adjusting apparatus 115 correspond substantially to the structure as described above with respect to FIGS. 1–4.

In other constructions, the thrust members can act against or can be operatively coupled to a movable reticle or other adjustable sight elements of the telescope sight.

The present invention can also be used for those sights employing cross hairs which fade in or fade out during sighting and are especially used for night-sighting devices.

Thus, it can be seen that the present invention has provided a device for aligning an adjustable sight element in a weapons sight system but particularly for long barreled firearms including rifles and the like. The device may be employed on open or peep sights or telescope sights. The adjustment or setting of the sight is always particularly known by reference to the digital read-out screens and last settings of the adjustable sight elements will be quickly made visible from a suitable memory system.

It will be understood that this invention is susceptible to modifications to adapt it to different usages and conditions, and accordingly, it is desired to comprehend such modifications within this invention as may fall within the scope of the appended claims.

What is claimed is:

1. In a device for aligning an adjustable sight element in a sight system for rifles and the like, a housing having a vertical portion and adapted to be attached to a rifle, a vertically and horizontally adjustable sight element mounted on said housing, a printed circuit board electrode on said housing vertical portion and a second electrode on said adjustable sight element to define means responsive to the movement of said adjustable sight element, and digital read-out means connected to said movement responsive means for indicating visually the magnitudes of the horizontal adjustment and vertical adjustment of the adjustable sight element with respect to a predetermined zero setting.

2. In a device as claimed in claim 1, wherein said adjustable sight element comprises an aperture disc of a peep sight.

3. In a device as claimed in claim 1 wherein said printed circuit board is mounted on an inner surface of a plate covering a frontal surface of said housing.

4. In a device as claimed in claim 1 wherein said housing has a removable casing, said digital read-out means being disposed within said removable casing.

5. In a device as claimed in claim 1 wherein said digital read-out means comprises a pair of separate read-out screens, one of said screens being for horizontal movement and the other screen for vertical movement.

6. In a device as claimed in claim 1 wherein said digital read-out means comprises a single read-out screen, and means on said digital read-out means for selectively indicating one of said vertical movement and said horizontal movement on said screen.

7. In a device as claimed in claim 1 wherein said digital read-out means further comprises a battery and a memory circuit connected to said battery such that the last adjustable sight element setting is stored in the memory.

8. In a device as claimed in claim 7, and further comprising means for automatically switching off a power supply from said battery to said digital read-out means after a predetermined period of time.

9. In a device as claimed in claim 4 wherein said digital read-out means further comprises a battery and a memory circuit connected to said battery such that the last adjustable sight element setting is stored in the memory, said battery being disposed in said casing.

10. In a device as claimed in claim 1 wherein said electronic means is removable from the aligning device such that the user of the rifle is able to operate said device either mechanically or electronically.

11. In a device as claimed in claim 1 wherein said adjustable sight element comprises a telescope sight adjustably supported on said housing.

12. In a device as claimed in claim 1 wherein said adjustable sight element comprises a reticle of a telescope sight.

13. In a device as claimed in claim 1 wherein said adjustable sight element comprises an adjustable sight structure within a telescope sight fixedly mounted on the rifle.

14. In a device for aligning the reticle of a telescope sight on a rifle, a vertically and horizontally adjustable reticle for a telescope sight mounted on said housing, electronic means responsive to the displacement of said reticle, and digital read-out means connected to said electronic means for indicating visually the magnitudes of the horizontal movement and vertical movement of the reticle from a predetermined zero setting.

15. In a device for aligning an adjustable sight structure in a telescope sight fixedly mounted on a rifle and the like, a housing adapted to be attached to a rifle, said telescope sight having at least a portion thereof within said housing and having an adjustable sight structure therein, electronic means responsive to the adjusting movement of said sight structure, and digital read-out means on said housing and connected to said electronic means for indicating visually the magnitude of the vertical adjustment of said adjustable sight structure with respect to a predetermined zero setting.

16. In a device as claimed in claim 15 wherein said digital read-out means indicates visually the magnitudes of both the horizontal movement and vertical adjustment of said adjustable sight structure with respect to a predetermined zero setting.

* * * * *